United States Patent [19]

Fleischer

[11] 4,132,887

[45] Jan. 2, 1979

[54] COUNTING SYSTEM

[75] Inventor: Donald W. Fleischer, Wethersfield, Conn.

[73] Assignee: Veeder Industries Inc., Hartford, Conn.

[21] Appl. No.: 772,943

[22] Filed: Feb. 28, 1977

[51] Int. Cl.[2] ..... G06M 1/10

[52] U.S. Cl. ..... 235/92 FL; 235/92 C; 235/92 R; 235/94 A

[58] Field of Search ..... 235/92 FL, 92 C, 92 K, 235/92 CC, 151.34, 94 R, 94 A, 133 A, 137, 138

[56] References Cited

U.S. PATENT DOCUMENTS

| | | | |
|---|---|---|---|
| 2,973,145 | 2/1961 | Daniels et al. | 235/92 K |
| 3,211,332 | 10/1965 | Thielen | 235/92 K |
| 3,689,749 | 9/1972 | Johnson | 235/92 FL |

*Primary Examiner*—Joseph M. Thesz

*Attorney, Agent, or Firm*—Prutzman, Kalb, Chilton & Alix

[57] ABSTRACT

A fuel pump register with pairs of oppositely facing volume and cost counters, conventional reset means for resetting the counter wheels to zero between fluid deliveries, the volume counters being indexed in a conventional manner for registering the volume amount of fuel delivered, and the cost counters being indexed by a pair of electrical stepping motors with one stepping motor connected for indexing the lowest order counter wheels of both cost counters and the second stepping motor connected for indexing the second lowest order cost counter wheels of both cost counters, the remaining higher order counter wheels of both cost counters being indexed via transfer pinions in a conventional manner.

22 Claims, 6 Drawing Figures

COUNTING SYSTEM

BACKGROUND AND SUMMARY OF THE INVENTION

The present invention relates to a new and improved counting system having notable utility in registers of the type employed in fuel dispensing apparatus for registering the volume and cost amounts of fuel delivered and, for example, utility in the factory modification and/or field or factory conversion of existing fuel pump registers of the type shown and described in U.S. Pat. No. 2,814,444 of Harvey N. Bliss dated Nov. 26, 1957 and entitled "Register".

The conventional mechanical fuel pump register of the type shown and described in U.S. Pat. No. 2,814,444 has upper and lower resettable cost and volume counters on each of two opposite sides of the register for registering the cost and volume amounts of the fuel delivered. The register is conventionally employed with a mechanical variator (for example, of the type disclosed in U.S. Pat. No. 3,413,867 of Richard B. Hamlin dated Dec. 3, 1968 and entitled "Variator") operable for establishing and posting the desired unit volume price of fuel. The variator is connected for being driven by a fuel meter and for driving the volume and cost counters of the register for registering the volume amount of fuel delivered (e.g., in gallons) and the cost amount of fuel delivered in accordance with the volume amount of fuel delivered and the established unit volume price.

The mechanical cost counter drive train is rotated at a rate proportional to the established unit volume price and the volumetric rate of delivery and, therefore, for any given maximum volumetric rate of delivery, its maximum rate of rotation increases proportionally with the unit volume price of gasoline. Since the price of gasoline is escalating and is likely to continue to escalate, the cost counter drive train is and will continue to be rotated at correspondingly increasing rates. The resulting higher rotational speed decreases the life and increases the operating noise of the mechanical cost counter and its drive train. The higher rotational speed also increases the required drive torque transmitted from the meter through the variator to the cost counters and therefore decreases the useful life of the variator and the accuracy of the meter.

It is therefore a principal aim of the present invention to provide a new and improved counting system for a conventional fuel pump register for converting and/or modifying the register for increasing the useful life of the register and the reliability of its associated meter.

It is another aim of the present invention to provide new and improved register conversion means of the type described which permits conversion of existing mechanical registers with minimum inconvenience and downtime.

It is another aim of the present invention to provide a modified fuel pump register employing a new and improved cost counter drive system which substantially reduces the drive torque required for operating the cost counters and thereby substantially increases the operating life of the cost counters and the meter associated with the fuel pump register.

It is a further aim of the present invention to provide a new and improved gasoline pump register having an improved resettable cost counter.

It is another aim of the present invention to provide new and improved register conversion means useful in modifying the cost and/or volume section of conventional registers of the type described in the aforementioned U.S. Pat. No. 2,814,444.

It is a further aim of the present invention to provide a new and improved fuel pump register of the type described which is substantially the same size as existing fuel pump registers and such that the improved register can be readily substituted for an existing register and without further modification of the fuel pump.

It is another aim of the present invention to provide in a counting system of the type employing a bank of a plurality of coaxial counter wheels a new and improved wheel indexing system for indexing the bank of counter wheels.

It is a still further aim of the present invention to provide in a counting system of the type having an electrical pulse generator adapted to be driven for generating a pulse train with a pulse for each predetermined drive increment and a bank of a plurality of coaxial counter wheels of increasing order for displaying an accumulated count in accordance with the number of generated pulses, a new and improved counter wheel indexing system operable by the train of electrical pulses for indexing the bank of counter wheels for displaying an accumulated count in accordance with the number of generated pulses.

It is a further aim of the present invention to provide new and improved means for modifying the conventional fuel pump register for expanding the unit volume price range of its associated variator. In accordance with the present invention, the unit volume price of the conventional variator can be extended beyond the conventional maximum \$0.99-9/10 unit volume price without requiring additional drive torque through the variator and without diminishing the operational life of the cost counter wheels of the associated fuel pump register.

It is another aim of the present invention to provide a new and improved cost counting system for a conventional fuel pump register for converting and/or modifying the register for extending the price range of the associated variator from the conventional price range of \$0.000 to \$0.999 per gallon to an expanded price range of \$0.00 to \$9.99 per gallon.

It is a further aim of the present invention to provide a new and improved cost counting system for a conventional fuel pump register which employs conventional cost counter wheels mechanically resettable in a conventional manner and which employs a new and improved cost counter wheel drive system which provides for substantially reducing the required cost counter drive torque and increasing the useful life of the cost counter wheels and their drive train.

It is another aim of the present invention to provide a new and improved counter indexing system for a resettable fuel pump register for automatically removing any initial counter readout error which occurs when the register is reset.

It is a further aim of the present invention to provide a new and improved counting system for a conventional fuel pump register useful in fuel pump installations, such as self-service installations, having a remote readout of the amount of fuel delivered, and which provides a remote readout which correctly corresponds to the register readout at the fuel delivery pump.

It is a further aim of the present invention to provide in a counting system of the type having a bank of a plurality of coaxial counter wheels of increasing order of significance, a new and improved wheel indexing system for indexing the bank of counter wheels for registering a count. Also, in accordance with one embodiment of the present invention, the wheel indexing system provides a one-hundred increment lowest order wheel, for example, for registering a count from 0 to 99, and a new and improved indexing system for indexing the second order counter wheel therewith in a manner avoiding any readout ambiguity during count transfers from the lowest to the second order counter wheels.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENTS

Figure 1:
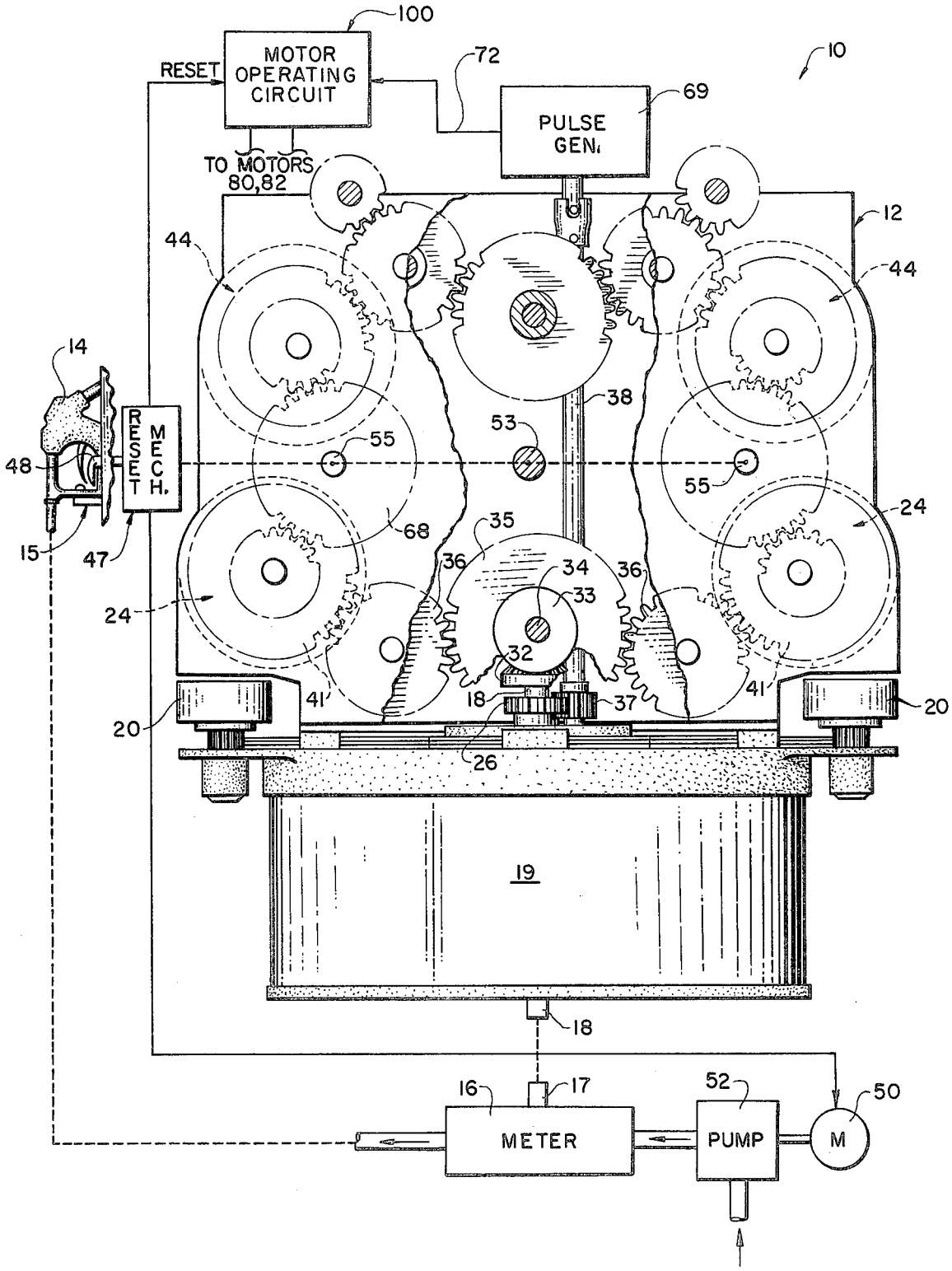
FIG. 1 is a partly diagrammatic side elevation view, partly broken away and partly in section, of a gasoline dispensing pump having a fuel pump register incorporating an embodiment of a counting system of the present invention.

Referring now to the drawings in detail wherein like reference numerals indicate like parts throughout the several figures, a gasoline delivery pump 10 employing a resettable register 12 incorporating an embodiment of a counting system of the present invention is shown having a nozzle 14 for delivering fuel and a suitable nozzle storage receptacle 15 for storing the nozzle 14 between fuel deliveries. In a conventional manner, a meter 16 provided in the fuel delivery conduit has a rotary output shaft 17 driven in accordance with the volume amount of fuel delivered. The meter shaft 17 is suitably coupled to an input or center shaft 18 of a variator 19 of the type described in the aforementioned U.S. Pat. No. 3,413,867. Briefly, the variator comprises three settable range arms (not shown) of ascending order of significance which can be individually manually set into engagement with selected gear steps of a cone gear (not shown) to collectively establish the desired unit volume price of fuel within a three-place unit volume price range. The variator also comprises two sets of three priceposting wheels 20 at opposite sides of the variator for displaying the established unit volume price. The three price wheels 20 of each set are mechanically connected to the respective range arms for posting the three-place unit volume price established by the range arm settings.

The variator center shaft 18 extends through the variator and is mechanically connected (via bevel gears 32, 33, a horizontal volume shaft 34, shaft and idler gears 35, 36, and lowest order wheel drive gears 41) for driving a pair of oppositely facing parallel volume counters 24 of the register 12 located directly above the variator price wheels 20. Thus, the two volume counters 24 are directly mechanically driven by the meter 16, in the shown embodiment via the variator center shaft 18, for registering the volume amount of fuel delivered.

A rotary output gear 26 of the variator rotatably mounted on the variator center shaft 18 is driven by the meter 16 via the variator cone gear and variator range arms in accordance with the established unit volume price. The variator output gear 26 is mechanically connected via a gear 37 for driving a vertical cost shaft 38 of the register. The vertical cost shaft 38 in conventional registers of the type disclosed in the aforementioned U.S. Pat. No. 2,814,444 is mechanically connected for driving a pair of oppositely facing parallel cost counters 44 located directly above the volume counters 24 for registering the cost amount of fuel dispensed in accordance with the volume amount dispensed and the unit volume price established by the variator setting. However, in accordance with the embodiment of the present invention shown in FIGS. 1 and 2, the conventional mechanical drive connecting the vertical cost shaft 38 to the cost counters 44 is removed in the case of a conversion, or is not employed in the case of an original construction of a modified register. Also, in each case a longer vertical cost shaft 38 is preferably provided in place of the usual vertical cost shaft (not shown) for driving a pulse generator 69 described more fully hereinafter. The resettable register 12 has a suitable conventional mechanical or motor driven reset mechanism 47 (shown diagrammatically in FIG. 1) operable by a register control handle 48. The register control handle 48 is positioned adjacent the nozzle storage receptacle 15 so that the handle 48 has to be rotated to its vertical or "off" position to permit the nozzle 14 to be placed in its storage receptacle at the completion of a fuel delivery, and so that the nozzle 14 has to be removed from its storage receptacle 15 to permit the handle 48 to be rotated to its horizontal or "on" position. Rotation of the handle 48 to its vertical or "off" position provides for de-energizing a pump drive motor 50 for a gasoline delivery pump 52 and for conditioning the register 12 for being reset, and rotation of the handle 48 to its horizontal or "on" position provides for operating the reset mechanism 47 for selectively rotating a center reset control shaft 53 and two wheel reset shafts 55 (FIG. 1) and thereby reset the volume and cost counter wheels to zero and then recondition the volume and cost counters 24, 44 for registering the volume and cost of the succeeding fuel delivery. Also, the register reset mechanism 47 is connected for re-energizing the pump motor 50 after the volume and cost counters 24 have been reset and the register 12 is conditioned for registering the subsequent delivery.

The cost counters 44 are preferably conventional cost counters excepting that the usual transfer pinion 54 located between the lowest order or right hand decade wheel 56 and the second decade wheel 57 (of the bank of four decade counter wheels 56–59 of increasing order of significance of each cost counter 44) is replaced by a separate indexing system (hereinafter described) employed for indexing the bank of three highest order counter wheels 57–59. Also, where a register of the type disclosed in the aforementioned U.S. Pat. No. 2,814,444 is employed, preferably the conventional second decade wheels are replaced by standard lowest order decade wheels (like the wheels 56 and for example of the type shown in U.S. Pat. No. 2,814,444) having (a) a forty-tooth metal drive gear 62 (instead of the usual twenty-tooth plastic drive gear 64 as provided on the remaining higher order counter wheels 58, 59) and (b) a two-hundred-fifty position drive clutch (not shown) between its drive gear 62 and indicator wheel 66 (instead of the usual twenty-position drive clutch as provided on the remaining higher order counter wheels 58, 59). In other words, preferably a standard right hand wheel like the lowest order wheel 56 is also used as the second order wheel 57. The remaining higher order counter wheels 58 and 59 are not replaced or modified and, for example, may be conventional wheels of the type shown in U.S. Pat. No. 3,223,316 of L. E. Coulter et al dated Dec. 14, 1965 and entitled "Counter Wheel Assembly".

The four cost wheels 56–59 of each cost counter 44 therefore have a generally conventional construction and are adapted to be reset to zero between fuel deliveries in a conventional manner by axially shifting their support shafts 67 and by rotating the wheel reset gears 68 (FIG. 1) via intermittent gearing (not shown) as described in U.S. Pat. No. 2,814,444. Accordingly, the four parallel volume and cost counters 24, 44 are mechanically reset together in a conventional manner, either manually generally as disclosed in U.S. Pat. No. 2,814,444 or by an electric motor-driven reset mechanism, for example as disclosed in U.S. Pat. No. 3,216,659 of E. C. Ambler et al dated Nov. 9, 1965 and entitled "Resetting Control Mechanism for Counting Device".

A rotary electrical pulse generator 69, for example, a rotary pulse generator of the type described in U.S. Pat. No. 3,786,272 of John G. Gamble et al dated Jan. 15, 1974 and entitled "Hall Effect Rotary Pulse Generator" is shown mounted above the register 12 in alignment with the vertical cost shaft 38 for being directly driven by the shaft 38. The pulse generator 69 has a suitable explosion-proof housing and is driven for generating a train of electrical cost pulses in its output 72 with a cost pulse for each predetermined angular increment of rotation of the vertical cost shaft 38 and therefore for each predetermined incremental cost amount of fuel delivered. In the shown embodiment, the pulse generator 69 is driven to provide two hundred equally spaced cost pulses for each revolution of the lowest order cost wheel 56, and therefore where the cost wheel 56 is a conventional "cents" decade wheel as shown in FIG. 2, two hundred pulses for each ten cents (or twenty pulses for each one cent) of fuel delivered.

Figure 2:
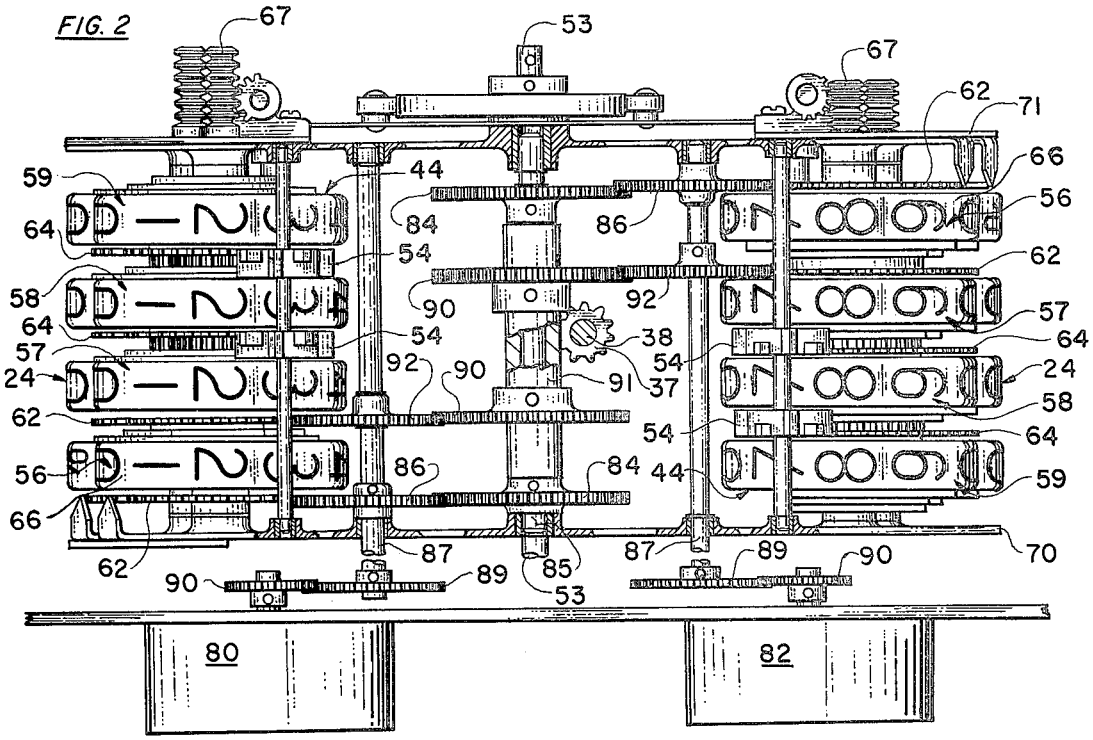
FIG. 2 is a partial top plan view, partly broken away and partly in section, of the fuel pump register, primarily showing a cost counter indexing mechanism of the register.

Referring to FIG. 2, the lowest order cost wheels 56 of the oppositely facing cost counters 44 are mechanically connected to be indexed together, each in the additive direction, by a rotary stepping motor 80. Similarly, the second order cost wheels 57 of the two cost counters 44 are mechanically connected to be indexed together, each in the additive direction, by a second rotary stepping motor 82. For that purpose, the drive gears 62 of the lowest order cost wheels 56 are interconnected via axially spaced gears 84 secured onto the usual horizontal cost center shaft 85 and via intermediate gears 86 in the conventional manner. The usual fixed stub shafts (not shown) conventionally used for supporting the intermediate gears 86 are replaced by elongated drive shafts 87 rotatably mounted within suitable bushings inserted into aligned bores in the register side plates 70, 71. The two drive shafts 87 are mounted to extend through one of the register side plates 70 to be driven via suitable gears 89, 90 by the two stepping motors 80, 82. One of the intermediate gears 86 is secured to its support shaft 87 to connect the stepping motor 80 for indexing the lowest order wheels 56 whereas the other intermediate gear 86 is rotatably mounted on the other support shaft 87.

Similarly, the drive gears 62 of the second order wheels 57 are interconnected via suitable axially spaced gears 90 secured onto a drive sleeve 91 (rotatably mounted on the center shaft 85) and intermediate gears 92 mounted on the drive shafts 87. One of the intermediate gears 92 is secured to its support shaft 87 for connecting the second order wheels 57 for being indexed by the second stepping motor 82.

The electrical stepping motors 80, 82 are suitably mounted at the side of the register 12 and have suitable explosion-proof housings.

Figure 5:
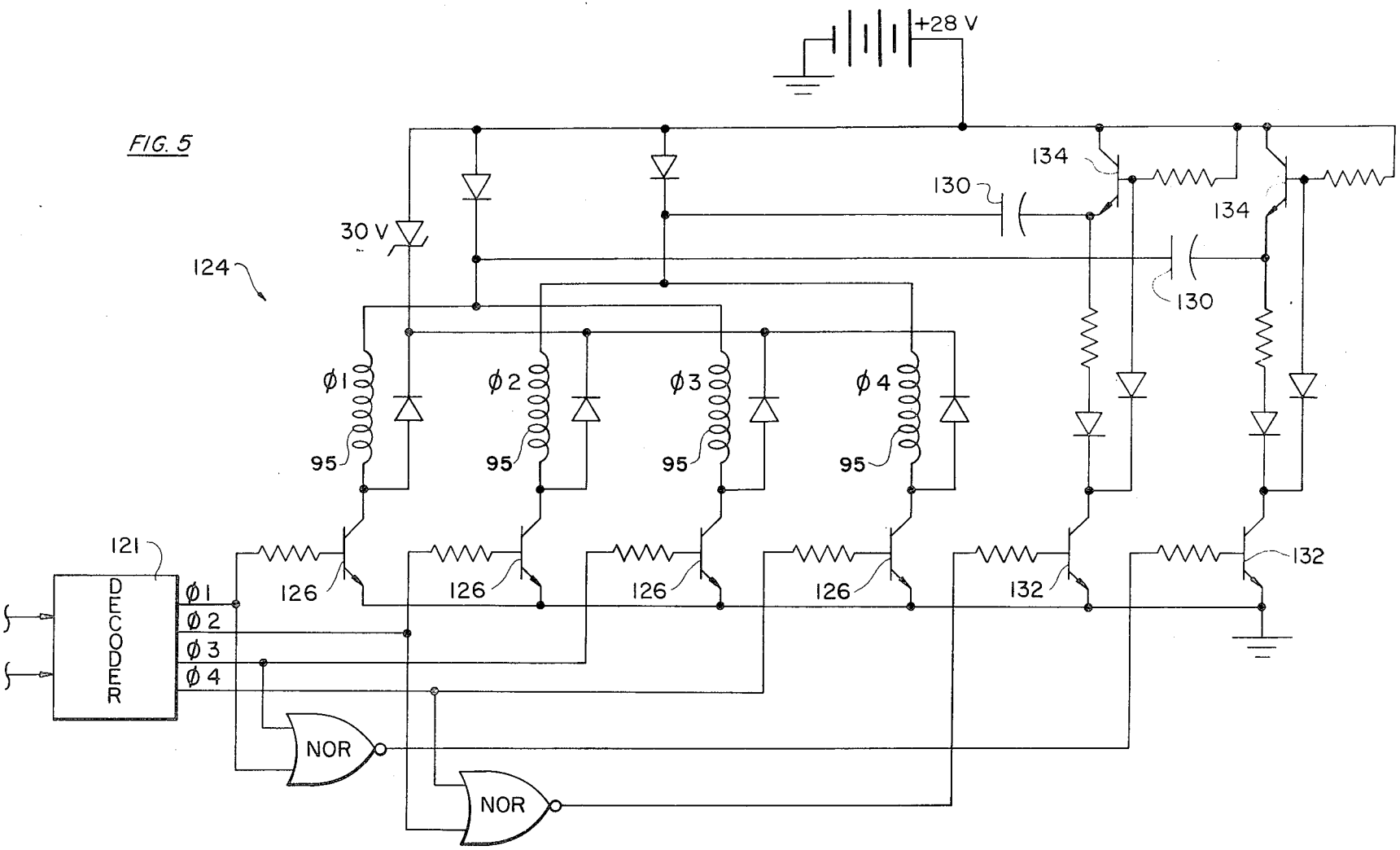
FIG. 5 is a schematic illustration, partly broken away, showing a motor drive circuit for the counting system.

In the shown embodiment, each stepping motor 80, 82 has a four-phase stepping cycle with four equiangularly spaced (i.e., 90° spaced) steps established by its four stepping coils 95 (FIG. 5). Also, each stepping motor 80, 82 is connected so that each respective pair of decade wheels 56, 57 is indexed twelve steps for each count or 36° of rotation of the decade wheels and whereby each stepping motor 80, 82 is operated through three complete four-step operating cycles for indexing the respective pair of counter wheels 56, 57 one count. Also, therefore, each stepping motor 80, 82 starts each count cycle at the same initial phase.

Figure 3A:
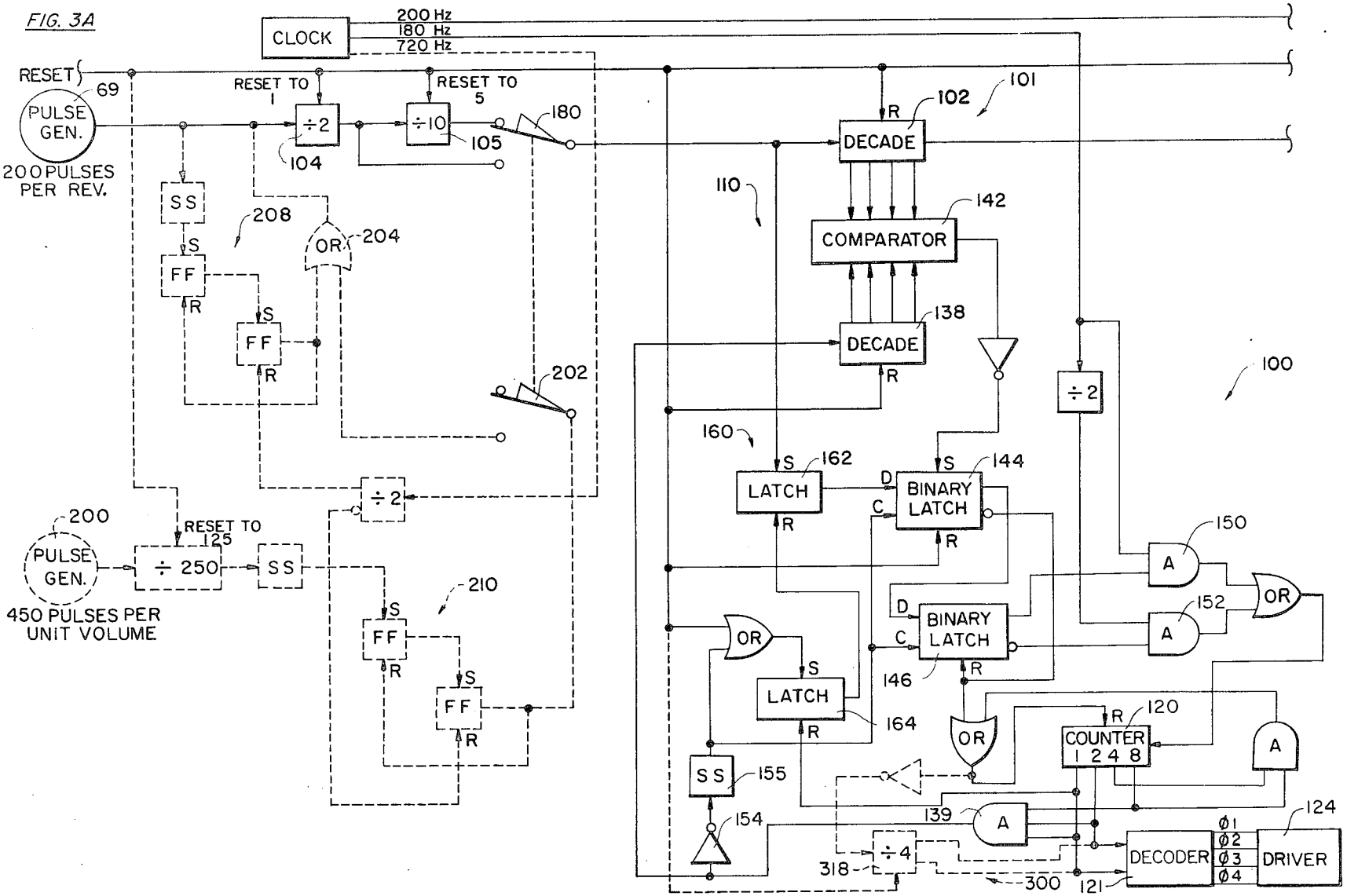
FIGS. 3A and 3B collectively are a generally schematic illustration, partly broken away, showing in full lines an embodiment of a motor operating circuit of the counting system and additionally showing modifications thereof in broken lines.
Figure 3B:
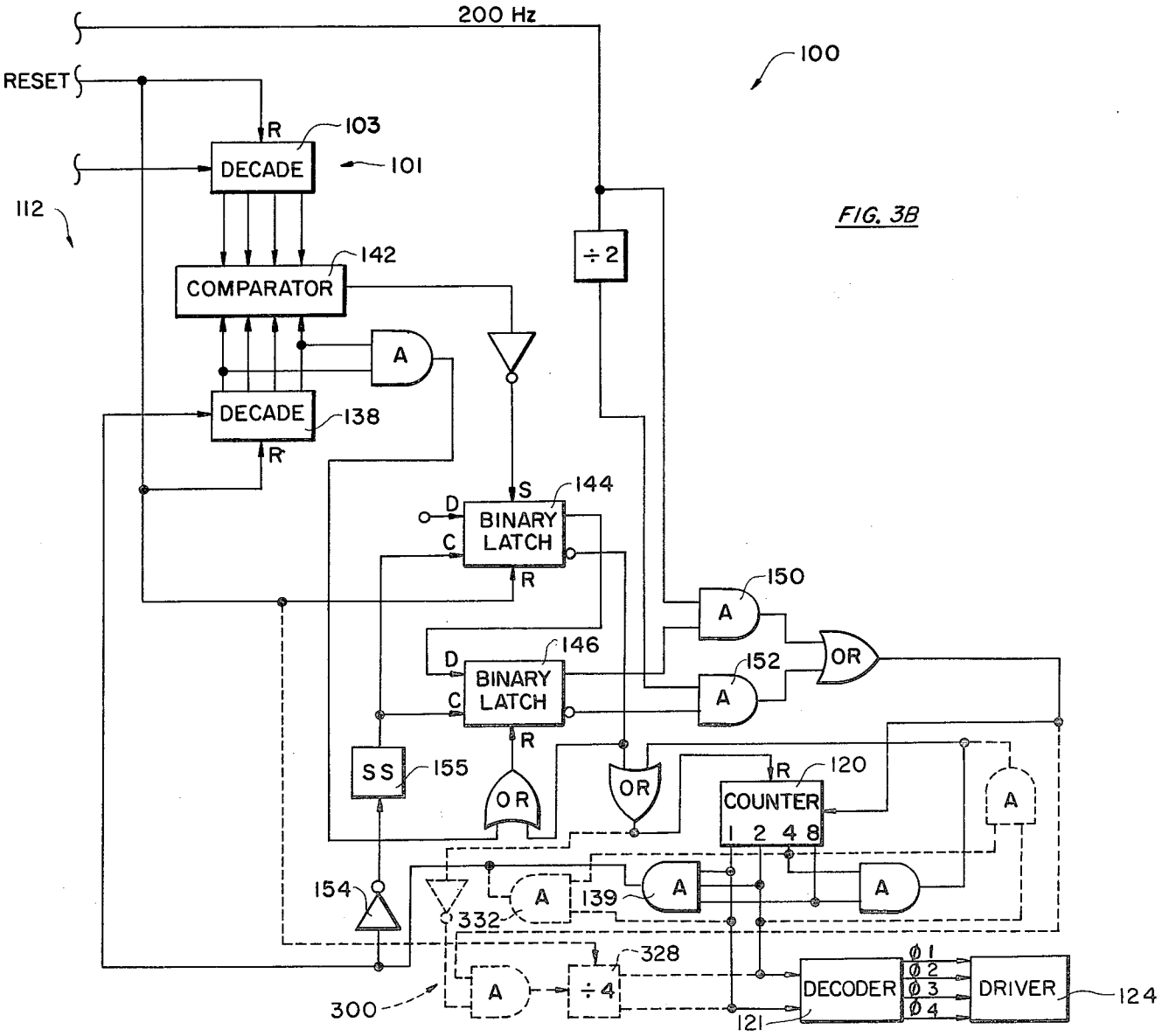

A functional stepping motor operating circuit 100, shown in full lines in FIGS. 3A and 3B and preferably principally provided by a suitable microprocessor, is employed for operating the stepping motor 80, 82 in accordance with the number of pulses generated by the pulse generator 69 for registering the cost amount of fuel delivered in accordance with the volume amount of fuel delivered and the unit volume price established by the variator setting.

The motor operating circuit 100 comprises a master storage counter 101 with two BCD master decades or counters 102, 103 of ascending order of significance for the stepping motors 80, 82 for the first and second decade wheels 56, 57 respectively.

The cost pulse generator 69 is connected via divide-by-two and divide-by-ten input counters 104, 105 respectively, to the lower order BCD decade 102, and in a conventional manner the lower order BCD decade 102 is connected to transmit a carry or transfer pulse to the higher order decade 103 for each ten input pulses to the lower order decade 102. The motor operating circuit 100, including the master storage counter 101 and the input counters 104, 105 are suitably connected to the register reset mechanism 47 to be reset between fluid deliveries when the volume and cost counters 24, 44 are reset and, for example, when the pump control handle 48 is turned to its "on" position or when the pump motor 50 is energized (but in any event to ensure that the motor operating circuit 100 is fully reset before the commencement of each delivery of fuel).

The pulse generator 69 is not reset in the described embodiment when the register 12 is reset (although, if desired, suitable mechanical means could be provided in the reset mechanism 47 for resetting the pulse generator 69 with the volume and cost counters 24, 44). Therefore, the input counters 104, 105 are preferably reset so that each one-cent cost pulse transmitted to the master storage counter 101 is timed to occur approximately when half of that cost increment of fuel is delivered.

During each fuel delivery, the BCD storage decades 102, 103 are stepped by the cost pulse generator 69 to accurately accumulate the first two decimal places of the cost amount of fuel delivered, it being seen that the lowest order BCD decade 102 is indexed one count for each twenty pulses from the pulse generator 69 and therefore one count for each one-cent cost amount of fuel delivered.

The motor operating circuit 100 employs separate slave circuits 110, 112 for indexing the stepping motors 80, 82 in accordance with the decade counts of the respective master decades 102, 103 respectively. Each slave circuit 110, 112 provides for operating the respective stepping motor 80, 82 through three four-step cycles (i.e. twelve steps) for each count or 36° rotation of the wheels 56, 57. The first stage slave circuit 100 provides for indexing the lowest order wheels 56 at a maximum rate of fifteen counts per second. Thus, if the master BCD decade 102 is indexed at a rate greater than fifteen counts per second, the wheels 56 will be indexed at their maximum rate, a rate at which they are visually unreadable. If the master decade 102 is indexed at a lesser rate, the wheels 56 will be indexed to closely track the master decade 102.

The second-stage slave circuit 112 provides for indexing the second counter wheels 57 to generally continuously track the count of the second-stage master decade 103 (at a maximum counting rate of 16⅔ counts per second, excepting that the counter wheels 57 are indexed at one-half that rate during count transfers as the counter wheels 57 are indexed from "9" to "0"). Thus, as the second master decade 103 is indexed at one-tenth the rate of the first master decade 102, the maximum available average stepping rate (of about fifteen counts per second) is established to ensure that the second wheels 57 are indexed to generally continuously track the cost count of the second decade 103.

In each slave circuit 110, 112, a binary counter 120 is connected to be indexed through a twelve-step cycle for stepping the respective four-phase motor 80, 82 twelve steps (i.e., three full four-phase cycles) for indexing the respective counter wheels 56, 57 one full count. More particularly, each stepping counter 120 is connected via a suitable decoder 121 and a motor drive circuit 24 (shown schematically in FIG. 5) to step the respective motor 80, 82. And, the four coils 95 of each stepping motor 80, 82 are energized in sequence through three four-phase cycles to index the respective counter wheels 56, 57 one count or 36° each time the stepping counter 120 is cycled.

Referring to FIG. 5, each motor drive circuit 124 comprises a suitable Darlington switching transistor 126 for controlling the operation of each motor stepping coil 95 and a pair of suitable capacitors 130 connected for increasing the rate of coil energization (and thereby increase the motor stepping rate). And with the capacitor circuit provided, it has been found that the desired motor stepping rate can be obtained with a relatively low 28 volt power supply as shown. Each capacitor 130 is connected to be charged during alternate motor operating phases by connecting the capacitor 130 to ground via a switching transistor 132. When each stepping coil 95 is energized, the low or ground potential lead of the respective capacitor 130 is connected to the 28 volt power supply via a switching transistor 134 to momentarily increase the applied voltage to the stepping coil 95, initially to approximately 56 volts, thereby substantially increasing the rate of energization of the coil 95.

Referring to FIGS. 3A and 3B, the first and second stage slave circuits 110, 112 employ slave decades 138 which are connected via AND gates 139 to be indexed at the eleventh step of each twelve-step count cycle of the counter 120. The count of each slave decade 138 therefore remains substantially in synchronism with the respective decade counter wheels 56, 57. A comparator 142 in each slave circuit 110, 112 is connected to the respective master decade 102, 103 and slave decade 138 to selectively cycle the stepping counters 120 and thereby index the respective counter wheels 56, 57 to follow the counts of the master decades 102, 103 respectively.

In the first stage slave circuit 110 (which, as described, provides for indexing the lowest order decade wheels 56 asynchronously relative to the master decade 102 if the master decade counting rate is greater than fifteen counts per second), a clocked binary count control latch 144 is connected to be set by the comparator 142 when the master and slave decade counts do not compare. A reset hold signal applied to the stepping counter 120 and to a clocked binary frequency control latch 146 is thereby removed to permit the counter 120 to be stepped either at a rate of 180 Hz (via an AND control gate 150) or at a rate of 90 Hz (via an AND control gate 152).

The frequency control latch 146 and count control latch 144 are clocked (via an inverter 154 and single-shot 155) at the twelfth or last step of each count cycle to establish if the counter 120 is to be immediately stepped without interruption through a succeeding count cycle, in which event the counter 120 is stepped (via the AND gate 150) at the relatively high frequency of 180 Hz (in the first stage slave circuit 110 and 200 Hz in the second stage salve circuit 112). It can be seen that the first-stage stepping counter 120 is stepped at the relatively low 90 Hz frequency (via the AND gate 152) through the first count cycle of each fuel delivery and also periodically during a relatively slow delivery when the master decade 102 is indexed at a rate of less than fifteen counts per second. Accordingly, the lowest order counter wheels 56 are always initially indexed from a rest position at one-half the normal operating frequency for accelerating the wheels 56 smoothly and with greater torque and to thereby reduce any possibility of miscounting.

Also, a count predictive circuit 160 comprising a latch 162 and a timing control latch 164 are provided in the first-stage slave circuit 110 for avoiding any visible wheel pause if a compare signal is momentarily generated when the master decade 102 lapps and momentarily corresponds to the slave decade 138 at the twelfth step of the stepping counter 120. For that purpose, the timing control latch 164 is connected to permit the latch 162 to be set by an input count pulse to the master decade 102 which occurs between the first and twelfth steps of a count cycle of the stepping counter 120. If the latch 162 is set, the count control latch 144 is set at the twelfth step of the count cycle to step the counter 120 through a succeeding count cycle at 180 Hz. Therefore, the lowest order counter wheels 56 will be continuously stepped at the maximum rate of fifteen counts per second until the master decade 102 is indexed at a rate less than fifteen counts per second, whereupon the right hand counter wheels 56 will be indexed to catch and then track the master decade 102.

The second stage slave circuit 112 operates in general like the first stage circuit 110 to index the respective counter wheels 57, excepting that as previously indicated, the second counter wheels 57 are indexed to substantially track the second stage master decade 103. Thus, the count control latch 144 of the second stage slave circuit 112 is reset during the twelfth step of each count cycle of the counter 120 to condition the counter for receiving a count pulse in the form of a noncompare signal from the comparator. However, it will be seen that the second-stage slave circuit 112 permits part-time asynchronous operation of the counter wheels 57 (with the wheels 57 being up to a maximum of nine counts behind the master decade 103) without count loss. Also, the frequency control latch 146 in the second stage slave circuit 112 is connected for stepping the counter 120 at either 200 Hz or 100 Hz and at the relatively low rate of 100 Hz for accelerating the counter wheels 57 from rest and for indexing the counter wheels 57 from "9" (i.e., when the slave decade 138 has a 9 binary count) to "0". Accordingly, the counter wheels 57 are indexed at one-half the normal or maximum rate during the "9" to "0" count transfer interval during which one or both of the higher order counter wheels 58, 59 are indexed one count via the transfer pinions 54.

A price decimal point selector switch 180 may be provided as shown in FIG. 3A for selectively bypassing the divide-by-ten counter 105 and for thereby multiplying the unit volume price by a factor of ten. Thus, for example, if the variator 19 is set at a three-place unit volume price of 56/10, the established unit volume price would be $0.569 per unit volume (e.g., gallon) when the divide-by-ten counter 105 is connected in series with the first-stage master decade 102 as shown in FIG. 3A and $5.69 per unit volume when the divide-by-ten counter 105 is bypassed. Thus, when the counter 105 is bypassed, any three-place unit volume price up to $9.99 can be established in one-cent increments. Also, if the unit volume price is expected to be greater than, for example, $5.00, an asynchronous slave circuit like the first stage slave circuit 110 is preferably employed instead of the tracking slave circuit 112 for operating the second counter wheels 57 and a third-stage stepping motor system (not shown) like the second-stage stepping motor system described is employed in place of the transfer pinion 54 between the wheels 57, 58 for indexing the third-stage counter wheel 58 (and for indexing the fourth-stage counter wheel 59 via their transfer pinions 54).

In addition, it may be desirable to further modify the standard register as shown in part in broken lines in FIG. 3A, to employ a volume pulse generator 200 like the cost pulse generator 69 but connected, for example, to the horizontal volume shaft 34 to generate a volume pulse train with a pulse for each predetermined volume increment of fuel delivered. For example, as shown in FIG. 3A, the volume pulse generator is connected to generate a train of 450 pulses for each unit volume (e.g., gallon) on which the unit volume price of the fuel is based. The modified circuit shown provides for adding cost pulses (i.e., one-half cent cost pulses) via a switch 202 and an OR gate 204 to the input of the divide-by-two counter 104 when the price decimal switch 180 is switched to bypass the divide-by-ten counter 105. The half-cent pulses are generated at a rate which provides for adding $0.009 (9/10th of a cent) for each unit volume (e.g., gallon) which is dispensed when the high price range is selected with the price decimal switch 180.

Also, with the modified input circuit shown in broken lines in FIG. 3A, the cost pulse generator 69 is connected via a pulse sequence control circuit 208 and the OR gate 204 to the divide-by-two counter 104 as shown in broken lines, rather than directly to the counter 104 as shown by a solid line in FIG. 3A. A similar pulse sequence control circuit 210 is provided for the pulse train from the volume pulse generator 200, and the two control circuits 208, 210 are alternately operated by a 720 Hz clock for feeding the two pulse trains to the OR gate 204.

A modified counting system 300 (with modifications shown in part in FIG. 4 and in part in broken lines in FIGS. 3A and 3B) may be employed with a hundred count or increment right hand wheel that is substantially identical to the right hand wheel 56 excepting that its wheel rim would bear suitable indicia for one-hundred equally spaced (i.e., 3.6° spaced) increments of the wheel for registering a cost of from 0 to 99 cents. Also, the first-stage stepping motor 80 is geared to the hundred-increment wheels to index the wheels one increment or one cent for each step of the motor 80. Accordingly, the modified counting system 300 provides for stepping the motor 80 one step for each count of the right hand wheel (instead of through three full four-step cycles as previously described).

Figure 4:
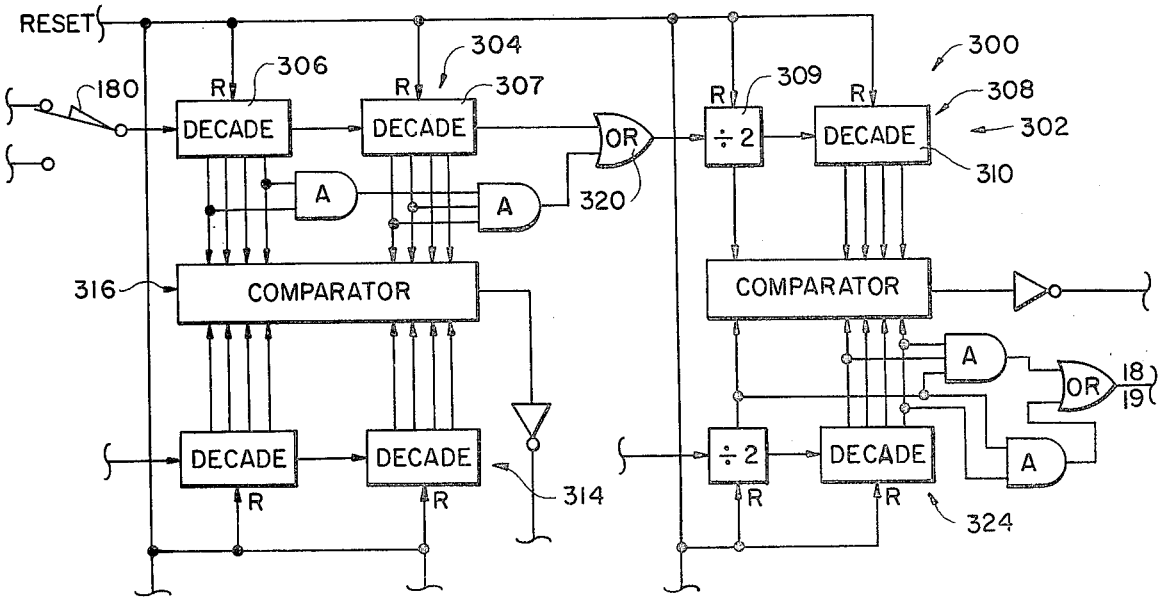
FIG. 4 is a generally schematic illustration, partly broken away, showing a further modification of the full line embodiment of the motor operating circuit of FIGS. 3A and 3B.

Referring to FIG. 4, the modified counting system 300 employs a modified master counter 302 with a first-stage master hundred counter 304 (with series connected binary decade counters 306, 307) and a second-stage master twenty counter 308 (with series connected two-count and decade counters 309, 310). A first-stage slave hundred counter 314 similar to the master hundred counter 304 and a suitable comparator 316 are employed for setting the count control latch 144 when the master and slave counters 302, 314 do not compare. Also, referring to FIG. 3A, a four counter 318, connected to be indexed one count for each twelve-step cycle of the stepping counter 120, provides the binary input to the decoder 121 (instead of the counter 120) for indexing the motor 80 one step or phase for each cycle of the stepping counter 120. The slave counter 314 is indexed one count for each cycle of the counter 120 to remain in sychronism with the hundred-increment lowest order counter wheels. The counter 120 is preferably selectively stepped to provide a maximum wheel counting speed, for example, of 150 counts per second, in which case the counter 120 is stepped at 1800 Hz via the AND gate 150 and at 900 Hz via the AND gate 152.

Also, referring to FIG. 3B, the modified counting system 300 provides for indexing the second-stage motor 82 in six-step one-half-count cycles to provide one-half-count transfers to the wheels 57 for avoiding ambiguous counter readouts as the lowest order wheels are stepped from "95" to "00". For that purpose, as functionally shown in FIG. 4, one-half-count transfer pulses are transmitted from the first-stage hundred master counter 304 via an OR gate 320 to the second stage master twenty counter 308 at the "95" and "00" counts of the first stage master counter 304.

A second-stage slave twenty counter 324 and a suitable comparator 326 are provided for selectively setting the second-stage count control latch 144 when the master and slave counters 308, 324 do not compare. Also referring to FIG. 3B, a four counter 328 is connected to be stepped six times for indexing the wheels 57 six steps or one-half count for each cycle of the stepping counter 120. For that purpose, the counter 120 is connected to have a six-step cycle rather than a twelve-step cycle as previously described. Also, an AND gate 332 is employed for indexing the slave counter 324 at the fifth step of the counter 120 and for clocking the latches 144, 146 at the sixth step of the counter 120.

The described fuel pump register modifications are therefore useful in the conversion of standard fuel pump registers for increasing the useful life of the fuel pump register and its associated meter and variator. Such a modified fuel pump register could incorporate a substitute volume counting system like the substitute cost counting system described. In addition, it is contemplated that the variator could be replaced by a volume pulse generator (connected to be driven directly by the meter 16, for example, or by the horizontal volume shaft 34) and a suitable presettable electronic cost computer (for example, of the type described in U.S. Pat. No. 3,696,236 of Crawford M. Kus. dated Oct. 3, 1972 and entitled "Computing Device") operable by the volume pulses from the volume pulse generator to generate cost pulses for stepping the first-stage master counter 101 or master counter 304 as the case may be, to accurately accumulate the cost amount of fuel delivered in accordance with a unit volume price established by the setting of the electronic cost computer. In that event, the single volume pulse generator would provide the volume pulse input to the electronic cost computer and if a volume counting system is also provided, the volume pulse input to the motor operating circuit of the volume counter section. Alternatively, the volume counters 24 could be mechanically driven by the meter 16 as described (even though a variator 19 is not provided).

As will be apparent to persons skilled in the art, various modifications, adaptations and variations of the foregoing specific disclosure can be made without departing from the teachings of the present invention.

We claim:

1. In a fuel pump delivery registration system for registering the volume and cost amounts of each fuel delivery and having resettable volume and cost counter sections with pairs of oppositely facing resettable volume and cost counters respectively, with respective banks of coaxial resettable counter wheels of increasing order, for registering the volume and cost amounts of fuel delivered respectively; volume counter operating means, including first mechanical drive means mechanically connected for mechanically indexing the banks of volume counter wheels for registering the volume amount of fuel delivered; cost counter operating means, including second mechanical drive means mechanically connected for mechanically indexing the banks of cost counter wheels for registering the cost amount of fuel delivered; and counter reset means mechanically connected to the banks of cost and volume counter wheels separately from the first and second mechanical drive means for separately mechanically resetting the cost and volume counter wheels and selectively operable for mechanically resetting the banks of cost and volume counter wheels between fuel deliveries; the improvement wherein the cost counter operating means comprises first and second electrical motors, wherein the second mechanical drive means comprises first and second wheel drive means mechanically connecting the first and second electrical motors respectively for indexing the lowest order and second lowest order cost counter wheels respectively for registering the corresponding order cost amounts of fuel delivered, and wherein the cost counter operating means comprises motor operating means for operating the first and second electrical motors for indexing the lowest order and second lowest order cost counter wheels for registering the corresponding order cost amounts of fuel delivered.

2. A fuel pump delivery registration system according to claim 1 wherein the motor operating circuit means is operable for stepping the first electrical motor for indexing the lowest order cost counter wheels at a predetermined maximum counting rate when the counting rate of the corresponding order cost amount of fuel delivered is equal to and greater than said maximum rate and for indexing the lowest order cost counter wheels to generally track said corresponding order cost amount when its counting rate is less then said maximum rate.

3. A fuel pump delivery registration system according to claim 1 wherein the motor operating circuit means is operable for stepping the second electrical motor for indexing said second lowest order cost counter wheels to generally track the corresponding order cost amount of fuel delivered.

4. A fuel pump delivery registration system according to claim 1 wherein the lowest order cost counter wheels are hundred wheels for registering a corresponding hundreds order cost amount of fuel delivered.

5. Conversion means for converting a resettable fuel pump register operable for registering the cost and volume amounts of fuel delivered and having resettable volume and cost counter sections with pairs of oppositely facing resettable volume and cost counters respectively, with respective banks of resettable coaxial counter wheels of increasing order, for registering the volume and cost amounts of fuel delivered respectively; volume counter operating means, including first mechanical drive means mechanically connected for mechanically indexing the banks of volume counter wheels for registering the volume amount of fuel delivered; cost counter operating means, including second mechanical drive means mechanically connected for mechanically indexing the banks of cost counter wheels for registering the cost amount of fuel delivered; and register reset means mechanically connected to the banks of cost and volume counter wheels separately from the first and second mechanical drive means for mechanically resetting the cost and volume counter wheels between fuel deliveries; the improvement wherein the conversion means comprises pulse generating means for generating an electrical pulse train with an electrical pulse for each predetermined incremental amount of fuel delivered; first and second electrical motors, first and second wheel drive means mechanically connecting the first and second electrical motors respectively for indexing the lowest order and second lowest order cost counter wheels respectively for registering the corresponding order cost amounts of fuel delivered; motor operating means connected to be operated by the electrical pulse train for operating the first and second electrical motors for indexing the lowest order and second lowest order cost counter wheels for registering the corresponding order cost amounts of fuel delivered in accordance with the number of pulses generated by the pulse generating means.

6. Resettable fuel pump register conversion means according to claim 5 wherein the conversion means further comprises hundred count lowest order cost counter wheels for registering a corresponding hundreds order cost amount of fuel delivered.

7. In a resettable counter having a bank of a plurality of at least three counter wheels of increasing order of significance and operable for accumulating a multiple order count therewith, counter indexing means, including mechanical drive means connected to the bank of counter wheels for indexing the counter for accumulating a said multiple order count, and counter reset means mechanically connected to the bank of counter wheels separately from the mechanical drive means for separately mechanically resetting the counter wheels, the improvement wherein the counter indexing means comprises first electrical motor indexing means and second electrical motor indexing means; wherein the mechanical drive means comprises first and second wheel drive means mechanically connecting the first and second electrical motor indexing means for indexing the lowest and second lowest order counter wheels respectively for accumulating respective order counts therewith, and intermittent wheel drive means connecting each counter wheel of higher order than said second lowest order counter wheel for being intermittently indexed by the second electrical motor indexing means, simultaneously with the second lowest order counter wheel for accumulating a corresponding order count; and operating means for operating the first and second electrical motor indexing means for respectively indexing the lowest order counter wheel and the remaining higher order counter wheels for accumulating a multiple order count with the counter.

8. A counter according to claim 7 wherein the operating means operates the first electrical motor for indexing the lowest order counter wheel at a predetermined maximum counting rate when the counting rate of the corresponding order count is equal to and greater than said maximum rate and for indexing the lowest order counter wheel to generally track said corresponding order count when its counting rate is less than said maximum rate.

9. In a resettable fuel pump register for registering the cost and volume amounts of each fuel delivery and having a resettable cost counter section with a pair of oppositely facing resettable cost counters with respective parallel banks of a plurality of coaxial resettable counter wheels of increasing order; cost counter operating means, including mechanical drive means for mechanically indexing the banks of cost counter wheels for registering the cost amount of fuel delivered; and register reset means mechanically connected to the banks of cost counter wheels separately from said mechanical drive means for mechanically resetting the banks of cost counter wheels and operable for selectively mechanically resetting the banks of cost counter wheels between fuel deliveries; the improvement wherein the cost counter operating means comprises pulse generating means operable for generating an electrical pulse train with an electrical pulse for each predetermined incremental amount of fuel delivered, first and second electrical motors, the mechanical drive means comprising first and second wheel drive means mechanically connecting the first and second electrical motors respectively for indexing the lowest order and second lowest order cost counter wheels respectively for registering the corresponding order cost amounts of fuel delivered, and motor operating means connected to be operated by the electrical pulse train generated by the pulse generating means and to operate the first and second electrical motors for indexing the lowest order and second lowest order cost counter wheels to register the cost amount of fuel delivered in accordance with the number of pulses generated by the pulse generating means.

10. In a resettable fuel pump register for registering the cost amount of each fuel delivery and having a resettable cost counter with a bank of a plurality of at least three coaxial resettable counter wheels of increasing order; cost counter operating means, including mechanical drive means mechanically connected for mechanically indexing the bank of cost counter wheels for registering the cost amount of fuel delivered; and register reset means mechanically connected to the bank of cost counter wheels separately from said mechanical drive means for separately mechanically resetting the cost counter wheels and operable for selectively mechanically resetting the bank of cost counter wheels between fuel deliveries; the improvement wherein the cost counter operating means comprises first electrical motor indexing means and second electrical motor indexing means; wherein the mechanical drive means comprises first and second mechanical wheel drive means mechanically connecting the first and second electrical motor indexing means for indexing the lowest and second lowest order cost counter wheels respectively for registering corresponding order counts therewith, and intermittent wheel drive means connecting each counter wheel of higher order than said second lowest order counter wheel for being intermittently indexed by the second electrical motor indexing means, simultaneously with the second lowest order counter wheel, for registering a corresponding order count; and wherein the cost counter operating means comprises pulse generating means operable for generating an electrical pulse train with an electrical pulse for each predetermined incremental amount of fuel delivered, and motor operating circuit means connected to be operated by the electrical pulse train generated by the pulse generating means and to operate the first and second electrical motor indexing means for indexing the lowest order and the second lowest order and said higher order counter wheels for registering corresponding order cost amounts of the fuel delivery in accordance with the number of pulses generated by the pulse generating means.

11. In a fuel pump delivery registration system for registering the volume and cost amounts of each fuel delivery and having resettable volume and cost counter sections with pairs of oppositely facing resettable volume and cost counters respectively, with respective banks of coaxial resettable counter wheels of increasing order, for registering the volume and cost amounts of fuel delivered respectively; volume counter operating means, including first mechanical driven means connected for indexing the banks of volume counter wheels for registering the volume amount of fuel delivered; cost counter operating means, including second mechanical drive means connected for indexing the banks of cost counter wheels for registering the cost amount of fuel delivered; and counter reset means selectively operable for mechanically resetting the banks of cost and volume counter wheels between fuel deliveries; the improvement wherein the cost counter operating means comprises electrical stepping motor means connected to the second mechanical drive means for indexing the banks of cost counter wheels, and motor operating circuit means for stepping the electrical motor means for indexing the banks of cost counter wheels for registering the cost amount of fuel delivered, the electrical stepping motor means comprising first and second electrical stepping motors, the second mechanical drive means comprising first and second wheel drive means mechanically connecting the first and second electrical stepping motor respectively for indexing the lowest order and second lowest order cost counter wheels respectively for registering corresponding order cost amounts of fuel delivered, the motor operating circuit means being operable for stepping the second electrical stepping motor for indexing said second lowest order cost counter wheels to generally track the corresponding order cost amount of fuel delivered, the pair of oppositely facing cost counters have respective banks of at least three coaxial resettable counter wheels of increasing order; the second mechanical drive means comprising intermittent wheel drive means connecting each cost counter wheel of higher order than said second lowest order cost counter wheels for being intermittently indexed by the second electrical stepping motor simultaneously with the second lowest order counter wheels, for registering the corresponding order cost amount of fuel delivered; and the motor operating circuit means being operable to step the second electrical stepping motor at relatively lower and higher rates, for simultaneously indexing both said second lowest order and said higher order cost counter wheels and for solely indexing the second lowest order cost counter wheels to successive counts without interruption, respectively.

12. In a fuel pump delivery registration system for registering the volume and cost amounts of each fuel delivery and having resettable volume and cost counter sections with pairs of oppositely facing resettable volume and cost counters respectively, with respective banks of coaxial resettable counter wheels of increasing order, for registering the volume and cost amounts of fuel delivered respectively; volume counter operating means, including first mechanical drive means connected for indexing the banks of volume counter wheels for registering the volume amount of fuel delivered; cost counter operating means, including second mechanical drive means connected for indexing the banks of cost counter wheels for registering the cost amount of fuel delivered; and counter reset means selectively operable for mechanically resetting the banks of cost and volume counter wheels between fuel deliveries; the improvement wherein the cost counter operating means comprises electrical stepping motor means connected to the second mechanical drive means for indexing the banks of cost counter wheels, and motor operating circuit means for stepping the electrical motor means for indexing the banks of cost counter wheels for registering the cost amount of fuel delivered, the electrical stepping motor means comprising first and second electrical stepping motors, the second mechanical drive means comprising first and second wheel drive means mechanically connecting the first and second electrical stepping motors respectively for indexing the lowest order and second lowest order cost counter wheels respectively for registering corresponding order cost amounts of fuel delivered, the lowest order cost counter wheels being hundred wheels for registering a corresponding hundreds order cost amount of fuel delivered, the motor operating circuit means being operable for stepping the second electrical stepping motor for indexing said second lowest order counter wheels in two spaced one-half count steps.

13. A fuel pump delivery registration system according to claim 12 wherein the second of said two one-half count steps occurs at the hundredth count of said hundreds order cost amount of fuel delivered and the first of said two one-half count steps occurs at a preceding count of said hundreds order cost amount.

14. In a fuel pump delivery registration system for registering the volume and cost amounts of each fuel delivery and having resettable volume and cost counter sections with pairs of oppositely facing resettable volume and cost counters respectively, with respective banks of coaxial resettable counter wheels of increasing order, for registering the volume and cost amounts of fuel delivered respectively; volume counter operating means, including first mechanical drive means connected for indexing the banks of volume counter wheel for registering the volume amount of fuel delivered; cost counter operating means, including second mechanical drive means connected for indexing the banks of cost counter wheels for registering the cost amount of fuel delivered; and counter reset means selectively operable for mechanically resetting the banks of cost and volume counter wheels between fuel deliveries; the improvement wherein the cost counter operating means comprises electrical stepping motor means connected to the second mechanical drive means for indexing the banks of cost counter wheels, and motor operating circuit means for stepping the electrical motor means for indexing the banks of cost counter wheels for registering the cost amount of fuel delivered, the electrical stepping motor means comprising first and second electrical stepping motors, the second mechanical drive means comprising first and second wheel drive means mechanically connecting the first and second electrical stepping motors respectively for indexing the lowest order and second lowest order cost counter wheels respectively for registering corresponding order cost amounts of fuel delivered, the motor operating circuit means being operable for stepping the second electrical stepping motor at relatively lower and higher rates, for indexing the lowest order cost counter wheels at relatively lower and higher counting rates respectively, as the lowest order cost counter wheels are indexed to a succeeding count from a prior count rest condition and are indexed to successive counts without interruption, respectively.

15. Conversion means for converting a resettable fuel pump register operable for registering the cost and volume amounts of fuel delivered and having resettable volume and cost counter sections with pairs oppositely facing resettable volume and cost counters respectively, with respective banks of resettable coaxial counter wheels of increasing order, for registering the volume and cost amounts of fuel delivered respectively; volume counter operating means, including first mechanical drive means connected for indexing the banks of volume counter wheels for registering the volume amount of fuel delivered; cost counter operating means, including second mechanical drive means for indexing the banks of cost counter wheels for registering the cost amount of fuel delivered; and register reset means for mechanically resetting the cost and volume counter wheels between fuel deliveries; the improvement wherein the conversion means comprises pulse generating means for generating an electrical pulse trail with an electrical pulse for each predetermined incremental amount of fuel delivered; electrical stepping motor means connected to the second mechanical drive means for indexing the banks of cost counter wheels for registering the cost amount of fuel delivered; motor operating circuit means connected to be operated by the electrical pulse train for stepping the electrical motor means for indexing the banks of cost counter wheels for registering the cost amount of fuel delivered in accordance with the number of pulses generated by the pulse generating means, the electrical stepping motor means comprising first and second electrical stepping motors; and for the second mechanical drive means, first and second wheel drive means mechanically connecting the first and second electrical stepping motors respectively for indexing the lowest order and second lowest order cost counter wheels respectively for registering corresponding order cost amounts of fuel delivered; the pair of oppositely facing cost counters having respective banks of at least three coaxial resettable counter wheels of increasing order; the second mechanical drive means comprising intermittent wheel drive means connecting each cost counter wheel of higher order than said second lowest order cost counter wheels for being intermittently indexed by the second electrical stepping motor simultaneously with the second lowest order cost counter wheels for registering the corresponding order cost amount of fuel delivered; and the motor operating circuit means being operable for stepping the second electrical stepping motor at relatively lower and higher rates, as the motor is stepped for simultaneously indexing said higher order and said second lowest order cost counter wheels and for solely indexing the second lowest order cost counter wheels to successive counts without interruption, respectively.

16. Conversion means for converting a resettable fuel pump register operable for registering the cost and volume amounts of fuel delivered and having resettable volume and cost counter sections with pairs of oppositely facing resettable volume and cost counters respectively, with respective banks of resettable coaxial counter wheels of increasing order, for registering the volume and cost amounts of fuel delivered respectively; volume counter operating means, including first mechanical drive means connected for indexing the banks of volume counter wheels for registering the volume amount of fuel delivered; cost counter operating means, including second mechanical drive means connected for indexing the banks of cost counter wheels for registering the cost amount of fuel delivered; and register reset means for mechanically resetting the cost and volume counter wheels between fuel deliveries; the improvement wherein the conversion means comprises pulse generating means for generating an electrical pulse train with an electrical pulse for each predetermined incremental amount of fuel delivered; electrical stepping motor means connected to the second mechanical drive means for indexing the banks of cost counter wheels for registering the cost amount of fuel delivered; motor operating circuit means connected to be operated by the electrical pulse train for stepping the electrical motor means for indexing the banks of cost counter wheels for registering the cost amount of fuel delivered in accordance with the number of pulses generated by the pulse generating means; the electrical stepping motor means comprising first and second electrical stepping motors; and, for the second mechanical drive means, first and second wheel drive means mechanically connecting the first and second electrical stepping motors respectively for indexing the lowest order and second lowest order cost counter wheels respectively for registering corresponding order cost amounts of fuel delivered; and hundred count lowest order cost counter wheels for registering a corresponding hundreds order cost amount of fuel delivered; the motor operating circuit means being operable for stepping the second electrical stepping motor for indexing said second lowest order cost counter wheels in two spaced one-half count steps.

17. In a counter having a bank of a plurality of at least three counter wheels of increasing order of significance and operable for accumulating a multiple order count therewith, and counter indexing means, including mechanical drive means connected to the bank of counter wheels for indexing the counter for accumulating a said multiple order count, the improvement wherein the counter indexing means comprises first indexing means and second electrical motor indexing means; wherein the mechanical drive means comprises first and second wheel drive means mechanically connecting the first and second indexing means for indexing the lowest and second lowest order counter wheels respectively for accumulating respective order counts therewith, and intermittent wheel drive means connecting each counter wheel of higher order than said second lowest order counter wheel for being intermittently indexed by the second electrical motor indexing means, simultaneously with the second lowest order counter wheels for accumulating a corresponding order count; and operating means for operating the first and second indexing means for respectively indexing the lowest order counter wheel and the remaining higher order counter wheels for accumulating a multiple order count with the counter, the lowest order counter wheel being a hundred wheel for registering a corresponding hundreds order count, and the operating means operating the second electrical motor indexing means for indexing said second lowest order counter wheel in two spaced one-half count steps.

18. In a counter having a bank of a plurality of at least three counter wheels of increasing order of significance and operable for accumulating a multiple order count therewith, and counter indexing means, including mechanical drive means connected to the bank of counter wheels for indexing the counter for accumulating a said multiple order count, the improvement wherein the counter indexing means comprises first indexing means and second electrical motor indexing means; wherein the mechanical drive means comprises first and second wheel drive means mechanically connecting the first and second indexing means for indexing the lowest and second lowest order counter wheels respectively for accumulating respective order counts therewith, and intermittent wheel drive means connecting each counter wheel of higher order than said second lowest order counter wheel for being intermittently indexed by the second electrical motor indexing means, simultaneously with the second lowest order counter wheels for accumulating a corresponding order count; and operating means for operating the first and second indexing means for respectively indexing the lowest order counter wheel and the remaining higher order counter wheels for accumulating a multiple order count with the counter, the first indexing means being a first electrical motor, and the operating means comprising master electronic counter means with first-stage and second-stage master counters for the lowest and second lowest order counter wheels respectively, and motor operating circuit means for operating the first electrical motor and second electrical motor indexing means for indexing the lowest order and second lowest order counter wheels respectively to correspond to the counts of the first-stage and second-stage master counters respectively.

19. A counter according to claim 18 wherein the motor operating circuit means operates the first electrical motor at a maximum rate asynchronously relative to the first-stage master counter until the count of the lowest order counter wheel corresponds to the count of the first-stage master counter.

20. A counter according to claim 18 wherein the first electrical motor is a multiple-phase stepping motor connected to be stepped through a count cycle of a fixed plurality of steps for each full count of the lowest order counter wheel, and wherein the motor operating circuit means continuously steps the first stepping motor through successive count cycles until the count of the lowest order counter wheel corresponds to the count of the first-stage master counter.

21. A counter according to claim 18 wherein the lowest order counter wheel is a hundred wheel for accumulating a corresponding hundreds order count of from 00 through 99, and wherein the motor operating circuit means operates the second electrical motor indexing means to index the second lowest order counter wheel in one-half count increments at two predetermined spaced counts of the first-stage master counter.

22. A counter according to claim 21 wherein said two predetermined spaced counts of the first-stage master counter are the ninety-fifth and hundredth counts thereof.

* * * * *

UNITED STATES PATENT AND TRADEMARK OFFICE

CERTIFICATE OF CORRECTION

PATENT NO. : 4,132,887

DATED : January 2, 1979

INVENTOR(S) : Donald Whiting Fleischer

It is certified that error appears in the above–identified patent and that said Letters Patent are hereby corrected as shown below:

Column 3, Line 42 "for" should read --of--

Column 7, Line 21 "100" should read --110--

Column 7, Line 50 "24" should read --124--

Column 9, Line 34 "56/10" should read --56 9/10--

Column 14, Line 56 of Claim 11 "driven" should read --drive--

Column 16, Line 52 of Claim 15 insert "of" after pairs

Column 16, Line 67 of Claim 15 "trail" should read --train--

Signed and Sealed this

*Twenty-fourth* Day of *July 1979*

[SEAL]

*Attest:*

*Attesting Officer*

LUTRELLE F. PARKER

*Acting Commissioner of Patents and Trademarks*